US005372614A

United States Patent [19]

Kitahara et al.

[11] Patent Number: 5,372,614

[45] Date of Patent: Dec. 13, 1994

[54] SLUDGE DISPERSING AGENT FOR FUEL OIL AND FUEL OIL COMPOSITION CONTAINING THE SAME

[75] Inventors: Shizuo Kitahara, Saitama; Kazuhisa Kanefuji; Akio Oda, both of Kanagawa; Hiromoto Inoura; Shigeru Kinomoto, both of Tokyo, all of Japan

[73] Assignees: Nippon Zeon Co., Ltd.; Nippon Oil Company, both of Tokyo, Japan

[21] Appl. No.: 38,977

[22] Filed: Mar. 29, 1993

[30] Foreign Application Priority Data

Mar. 31, 1992 [JP] Japan ..... 4-108884
Sep. 30, 1992 [JP] Japan ..... 4-285436

[51] Int. Cl.[5] ..... C10L 1/22; C10L 1/24

[52] U.S. Cl. ..... 44/371; 44/420; 44/422

[58] Field of Search ..... 44/311, 370, 371, 420, 44/422, 330

[56] References Cited

U.S. PATENT DOCUMENTS

| | | | |
|---|---|---|---|
| 2,548,630 | 4/1951 | Sorg et al. | 44/371 |
| 2,579,890 | 12/1951 | Wies et al. | 44/371 |
| 2,980,517 | 4/1961 | Kaken et al. | 44/422 |
| 3,116,128 | 12/1963 | Fareri et al. | 44/371 |
| 3,186,810 | 6/1965 | Dunworth | 44/422 |
| 3,210,169 | 10/1965 | Van der Minne et al. | 44/371 |
| 3,833,345 | 9/1974 | Tatsuke et al. | 44/422 |
| 4,550,142 | 10/1985 | Akita . | |
| 4,647,625 | 3/1987 | Aonuma . | |
| 4,667,153 | 6/1987 | Kitahara . | |
| 4,877,415 | 10/1989 | Kapuscinski et al. | 44/330 |

FOREIGN PATENT DOCUMENTS 63-23991 2/1988 Japan .

OTHER PUBLICATIONS

Schill et al "Synthesis" Int'l Journal of Methods in Synthetic Organic Chemistry, 1971 No. 2 Feb. Angew. Chem /75. Jahrg. 1963, pp. 604–621.

Journal of Japan Rubber Society, 43, 1970, pp. 966–1001., "Oil & Gas Journal" Apr. 8, 1985, A Pennwell Publication.

*Primary Examiner*—Jacqueline V. Howard

*Attorney, Agent, or Firm*—Lowe, Price, LeBlanc & Becker

[57] ABSTRACT

A sludge dispersing agent for fuel oils includes a polymer having at least one $>C{=}N^{+}<$ bond in its molecule and at least one compound selected from the group consisting of long-chain alkyl phosphates and alkyl sulfosuccinates and salts thereof.

8 Claims, No Drawings

SLUDGE DISPERSING AGENT FOR FUEL OIL AND FUEL OIL COMPOSITION CONTAINING THE SAME

FIELD OF THE INVENTION

The present invention relates to sludge dispersing agents for fuel oils, particularly, petroleum fuel oils such as A-type fuel oil, C-type fuel oil and A/C blended fuel oil (residual fuel oil blended with distillate), and more specifically to additives capable of preventing fuel oils making use of a cracked residue such as a thermal cracked oil or catalytically cracked oil from a heavy oil and a base poor in storage stability, for example, a vacuum residue such as a visbroken residue, from forming sludge, and of imparting improved filterability of fuel oil, storage stability, mixing stability and the like to the fuel oils. The present invention is also concerned with stable fuel oil compositions containing such an additive.

BACKGROUND OF THE INVENTION

Fuel oils are generally provided as products by suitably mixing a distillation residue and a distillate oil from petroleum with each other according to product specifications, and used as fuel oils for industrial boilers, heating furnaces and the like.

Residual oils generally comprise asphaltene, resins (malthene) and oil. A fuel oil containing such a residual oil causes various troubles such as clogging of fuel strainer and accumulation of sludge on the bottom of a fuel tank when the asphaltene is deposited as sludge. In an fuel oil good in storage stability, the asphaltene is dispersed as micelles in the resins and forms a sort of colloidal structure. In this case, the aromaticity of the base oil greatly affects stability. Insufficient aromaticity tends to aggregate and settle the asphaltene, resulting in formation of sludge.

In recent petroleum industry, it has been common to use deep drawing apparatus and fluid cat-crackers in atmospheric distillation, or secondary equipment such as thermal cracking apparatus and hydrocracking apparatus in order to cope with increased demand of gasoline to obtain more middle cut from crude oil. In fuel oils making use of residual oils, particularly, C-type fuel oil, this is attended more often than before with problems of reduced storage stability and filterability of fuel oil due to the formation of heavier residues and mixing of light cycle oil (LCO) therein. This reason is considered that the amount of cracked residue and visbroken residue used as a base for a fuel oil increase, and in particular, asphaltene and a saturated component in the residual oil contained in C-type fuel oil become increased, while the resins and aromatic component therein are decreased, so that the asphaltene forming micelles in the petroleum resin becomes deposited as sludge. Therefore, even when A-type fuel oil containing a great amount of the saturated component is blended with C-type fuel oil or the like, sludge is liable to form, resulting in a blend poor in mixing stability.

As dispersing agents for preventing the occurrence of asphaltene sludge in fuel oils, there have hitherto been used, for example, metal salts of sulfonic acid and naphthenic acid, long-chain alkyl dithiophosphates, surfactants such as higher fatty acid esters, and high-molecular weight compounds containing methacrylates and/or maleic acid groups. As a residual fuel oil additive for preventing the occurrence of sludge, it has recently been proposed to use a mixture a long-chain alkyl phosphate and an imidazoline derivative or a hydrolyzate thereof (Japanese Patent Application Laid-Open No. 23991/1988).

However, the conventionally known additives are still insufficient in respect of the effect to prevent the occurrence of sludge. There is thus a demand for the development of an additive capable of more improving the stability of fuel oils.

OBJECTS AND SUMMARY OF THE INVENTION

It is an object of the present invention to provide a sludge dispersing agent for fuel oils, which can improve the filterability of fuel oil, storage stability and mixing stability of the fuel oils.

It is a more specific object of the present invention to provide a sludge dispersing agent for fuel oils, which can remedy the above-described problems attributable to asphaltene sludge formed by aggregation of asphaltene in a distillate oil component, said asphaltene being contained in a residual oil component in a fuel oil making use of a cracked base, and a fuel oil composition containing such a dispersing agent and improved in stability.

The present inventors have carried out an extensive investigation with a view toward solving the above-described problems involved in the prior art. As a result, it has been found that when a specific modified polymer with at least one functional group, which can interact with polar groups (—COOH, >C=O, —OH, —$NO_2$, etc.) contained in asphaltene, introduced in its molecule (in the molecular chain and/or on an end of the molecular chain) is added to a fuel oil in combination with a long-chain alkyl phosphate and/or an alkyl sulfosuccinate or salt thereof, the stability of the fuel oil is improved. The present invention has been led to completion on the basis of this finding.

According to the present invention, there is thus provided a sludge dispersing agent for fuel oils, comprising (1) a polymer having at least one >C=N+< bond in its molecule and (2) at least one compound selected from the group consisting of long-chain alkyl phosphates represented by the following general formula [I]:

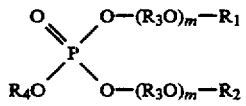

[I]

wherein $R_1$ and $R_2$ mean individually a hydrocarbon radical having 8–30 carbon atoms, $R_3$ denotes an alkylene group having 2–4 carbon atoms, $R_4$ represents a hydrogen atom or a hydrocarbon radical having 1–30 carbon atoms, and m and n stand individually for an integer of 0–20, and alkyl sulfosuccinates and salts thereof represented by the following general formula [II]:

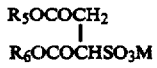

[II]

wherein $R_5$ and $R_6$ mean individually a hydrogen atom or a hydrocarbon radical having 4–18 carbon atoms, and M denotes a hydrogen or alkali metal atom.

DETAILED DESCRIPTION OF THE INVENTION

Features of the present invention will hereinafter be described in detail.

(Fuel oil)

The fuel oils referred to in the present invention are prepared by suitably mixing a distillation residue and a distillate oil from petroleum with each other according to product specifications, and include those classified by usage into A-, B- and C-type fuel oils, which correspond respectively to the first, second and third fuel oils prescribed in JIS K-2205 (which correspond respectively to No. 4, No. 5 and No. 6 fuel oil in ASTM). In general, A-type fuel oil contains 0.05–2% of the distillation residue, B-type fuel oil contains 40–60% of the distillation residue, and C-type fuel oil contains 5–30% of the distillate oil (all based on the volume of the respective fuel oils). The effect of the present invention as a low-temperature flowability improver is remarkably exhibited for fuel oils including, as the distillate oil, at least one cracked oil from a heavy oil, such as catalytically cracked gas oil, indirectly desulfurized, cracked gas oil or hydrocracked gas oil.

Distillation Residue Component

The term "distillation residue" as used in the present invention means a generic term for heavy oils taken out of the bottom of a distilling column and is contrasted with the term "distillate oil". The distillation residue can be classified specifically into reduced crude, vacuum residue and cracked residue.

The reduced crude is a heavy bottom oil remaining on the bottom of a distilling column upon distilling a crude oil by a topping plant and having a boiling point of at least 400° C. and is commonly called "long residuum".

The vacuum residue is a superheavy bottom oil remaining on the bottom of a distilling column upon distillation of the reduced crude under reduced pressure, for example, by a vacuum distillation plant at 5–50 mmHg and is commonly called "short residuum".

Directly desulfurized reduced crude or directly desulfurized vacuum distillation residue obtained by reacting the reduced crude or vacuum distillation residue with hydrogen in the presence of a catalyst can also be used.

As examples of the cracked residue, may be mentioned distillation residues from thermal cracked oil obtained by thermally cracking the reduced crude or vacuum distillation residue under conditions of a reaction temperature of 400°–500° C. and a pressure of 5–30 kgf/cm$^2$; distillation residues from hydrocracked oil obtained by hydrocracking the reduced crude or vacuum residue in the presence of a catalyst such as molybdenum, nickel, tungsten, vanadium or cobalt under conditions of a reaction temperature of 400°–500° C. and a pressure of about 60–200 kgf/cm$^2$; distillation residues from catalytically cracked oil obtained by catalytically cracking the reduced crude or vacuum residue in the presence of a catalyst such as activated clay, silica-alumina or zeolite under conditions of a reaction temperature of 400-600° C; and the like.

In addition, residual oils extracted from the vacuum distillation residue with a solvent such as propane, kerosene or furrural may also be used.

These residual oils may be used in any combination with each other. The dispersing agent according to the present invention has a particular effect when it is added to a mixture of two or more different residual oils.

The distillation residue desirably contains asphaltene in an amount of at least 1.0 wt. %, preferably 1.0–20 wt. %, or carbon residue in an amount of at least 4.0 wt. %, preferably 5.0–30 wt. %.

The compositions of these residual oils may vary according to the kind of crude oil, operation conditions of a distilling column used and the like. However, the distillation residue is composed roughly of asphaltene, resins (malthene) and oil. The asphaltene is generally dispersed in the resins called a malthene layer. These components form a sort of colloidal (gel) structure.

Distillate Oil

The term "distillate oil" as used in the present invention means distillates obtained from a topping plant or a vacuum distillation plant, or hydrocarbons obtained by cracking or reforming these distillates and having a boiling point of 150°–450° C. at atmospheric pressure. As specific examples, may be mentioned straight distillates such as kerosene, gas oil and heavy gas oil.; cracked oils from heavy oils having a boiling point of at least 200° C., such as catalytically cracked gas oil, indirectly desulfurized cracked gas oil and hydrocracked gas oil; catalytically dewaxed heavy gas oil; catalytically dewaxed vacuum gas oil; and the like.

(Dispersing agent)

The dispersing agent in the present invention includes in combination (1) a polymer having at least one $>C{=}N^+<$ bond in its molecule (in the molecular chain and/or on an end of the molecular chain) [hereinafter abbreviated as "polymer (1)"] and (2) a long-chain alkyl phosphate represented by the general formula [I] and/or an alkyl sulfosuccinate or salt thereof represented by the general formula [II].

Polymer (1)

The polymer (1) as described above is a polymer substantially soluble in the distillate oil, specifically, a polymer soluble in the distillate oil in a temperature range of from −30° C. to 160° C. As such a polymer, a straight-chain or branched hydrocarbon polymer is principally preferred for straight distillates, while an alicyclic or aromatic hydrocarbon polymer is preferred for cracked distillates because they contain an aromatic component in a high proportion.

The polymer preferably contains the above-described bond (functional group) in a proportion of 1–10 bonds per molecule. No particular limitation is imposed on the molecular weight of the polymer. Such polymers include various polymer from oligomers to high polymers having a molecular weight of about hundreds of thousands). The polymer (1) according to the present invention may be used after hydrogenating its carbon-carbon unsaturated bonds, if necessary.

The polymer (1) is a polymer having at least one $C{=}N^+<$ bond in its molecular chain and/or on an end thereof. This bond can be introduced in the molecule chain of the polymer by polymerization reactions which will be described subsequently. Alternatively, this bond may be introduced in the molecule of the polymer by copolymerizing a monomer having this bond.

As exemplary starting polymers for the polymer (1), may be mentioned homopolymers of conjugated dienes such as 1,3-butadiene, isoprene, 1,3-pentadiene, 2,3-dimethyl-1,3-butadiene and 1,3-hexadiene, or olefinic monomers such as ethylene, propylene and α-olefins, and copolymers of these monomer and an aromatic vinyl compound such as styrene or vinyltoluene.

As specific preferable examples of the starting polymer, may be mentioned diene polymers such as styrene-butadiene copolymers (random copolymer and block copolymers of A-B type, A-B-A type, B-A-B type and the like, wherein A and B mean a polystyrene chain and a polybutadiene chain, respectively), styrene-isoprene block copolymers, styrene-piperylene copolymers, vinylnaphthalene-butadiene copolymers, styrene-isobutylene block copolymers, styrene-butadiene graft copolymers (also including comb type copolymers), acenaphthylene-butadiene copolymers, butadiene-isoprene copolymers, polybutadiene and polyisoprene.

In general, $>C{=}N^{+}<$ bonds are introduced first of all on at least one ends of these starting polymers, and then in their molecular chains.

(1) As a process for introducing a $>C{=}N^{+}<$ bond on at least one terminal of the molecular chain, may be mentioned the following process.

A polymer having an active terminal upon polymerization, i.e., a polymer with an alkali metal or alkaline earth metal bonded to its terminal is reacted with a compound having a bond represented by the following general formula [III]:

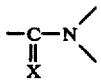

[III]

wherein X means oxygen or sulfur atom, N-substituted aminoaldehyde, N-substituted aminothioaldehyde, N-substituted aminoketone, N-substituted aminothioketone or the like, and the resulting reaction product is then hydrolyzed (see U.S. Pat. Nos. 4,550,142 and 4,647,625).

The living anionic polymer used in this process is a polymer (including oligomers to high-molecular weight polymers) obtained by polymerizing at least one monomer polymerizable by an anionic polymerization catalyst such as a catalyst based on an alkali metal and/or alkaline earth metal, and having the metal on at least one terminal thereof. A polymer obtained by adding the above-mentioned metal by an after reaction (addition reaction) to an unsaturated polymer may also be used.

No particular limitation is imposed on the metal-based catalyst used in the polymerization and addition reaction. Any catalysts used conventionally in anionic polymerization may be used. As examples of the alkali metal-based catalyst, may be mentioned organic lithium compounds having 2–20 carbon atoms such as n-butyl lithium and sec-butyl lithium. As examples of the alkaline earth metal-based catalyst, may be mentioned catalyst systems comprising, as a principal component, a compound of barium, strontium, calcium or the like. Catalysts usable in these reactions are however not limited to these catalysts only.

The polymerization reaction and the alkali metal- and/or alkaline earth metal-adding reaction are conducted in a hydrocarbon solvent used conventionally in anionic polymerization or a solvent by which the metal-based catalyst is not ruined, such as tetrahydrofuran, tetrahydropyran or dioxane.

The amount of the metal-based catalyst to be used in the polymerization reaction is generally in a range of 0.1–200 mM per 100 g of the monomer. Besides, the amount of the metal-based catalyst to be used in the addition reaction is generally about 0.1–10 mM per 100 g of the polymer though it varies according to the amount of the metal to be added.

The polymerization is generally conducted in the presence of a polar compound such as an ether compound, amine compound or phosphine compound as a randomizing and vinylating agent. In general, these polar compounds may also be used upon the addition reaction. No particular limitation is imposed on the conditions of the polymerization and addition reactions so far as they are conducted in accordance with the method known per se in the art.

Examples of the organic compound used in the reaction with the polymer with an alkali or alkaline earth metal bonded thereto are as follows.

As examples of the compound having the atomic group represented by the general formula [III], may be mentioned N-substituted lactams such as N-methyl-β-propiolactam, N-methyl-2-pyrrolidone, N-t-butyl-2-pyrrolidone, N-methyl-ε-caprolactam and N-phenyl-ω-laurylolactam, and their corresponding N-substituted thiolactams; N-substituted cyclic ureas such as 1,3-dimethyl-2-imidazolidinone and 1,3-dimethylethylene urea, and their corresponding N-substituted cyclic thioureas; and the like (see U.S. Pat. No. 4,647,625).

As exemplary organic compounds other than above, may be mentioned N-substituted aminoketones such as 4,4'-bis(dimethylamino)benzophenone, and their corresponding N-substituted aminothioketones; N-substituted aminoaldehydes such as 4-dimethylaminobenzaldehyde, and their corresponding N-substituted aminothioaldehydes (see U.S. Pat. No. 4,550,142).

The amount of these organic compounds to be used is generally in a range of 0.05–10 moles per mole of the metal bonded to the polymer. The reaction of the living anionic polymer or the like with the organic compound is conducted in the form of a solution in a solvent dissolving both compounds. Since the reaction takes place rapidly, the reaction temperature and reaction time may be widely chosen. However, the reaction is generally carried out at a temperature ranging from room temperature to 100° C. for several seconds to several hours. After the completion of the reaction, an intended polymer with an atomic group having a $>C{=}N^{+}<$ bond bonded to at least one terminal of its molecular chain can be obtained by hydrolyzing the reaction product, more specifically, for example, by a method in which an alcohol such as methanol or isopropyl alcohol is added as a coagulant to the reaction mixture, or a method in which the reaction mixture is subjected to steam stripping.

(2) As a process for introducing at least one $>C{=}N^{+}<$ bond in the molecular chain, may be mentioned the following processes.

(i) There is a process in which an organic compound (I) represented by the general formula, $R_1{-}CH{=}N{-}R_2$ wherein $R_1$ and $R_2$ mean individually an organic atomic group, and an organic acid halide are reacted with a polymer having at least one carbon-carbon unsaturated bond in its molecular chain in the presence of a Lewis acid (U.S. Pat. No. 4,677,153).

As examples of the organic compound (I), may be mentioned benzylideneaniline, benzylidene-butylamine, benzylidene-octylamine, etc. As specific examples of the organic acid halide, may be mentioned acetyl chloride, benzoyl chloride, etc. As examples of the Lewis acid, may be mentioned $BF_3$, $BF_3O(C_2H_5)_2$, $AlCl_3$, $TiCl_4$, $SnCl_4$, $SbCl_5$, $AgBF_4$, etc.

No particular limitation is imposed on reaction conditions and the like. In general, the reaction mixture is reacted for about 1–2 hours at 20°–80° C. in an inert solvent such as benzene, toluene or cyclohexane. Usually, the amounts of the organic compound (I) and organic acid halide are each about 0.1–30 parts by weight per 100 parts by weight of the polymer.

(ii) There is another process in which an N-hydroxymethylamide compound (N-methylol compound) is reacted with a polymer having at least one carbon-carbon unsaturated bond in its molecular chain in the presence of a Friedel-Crafts catalyst and, if necessary, the resultant product is reacted further with an alkyl halide, methyl p-toluenesulfonate or the like, thereby achieving N-alkylation [C. Giordano, et al., SYNTHESIS, 92 (1971)].

The N-hydroxymethylamide compound is a reaction product of an amide compound and an aldehyde compound. As the aldehyde compound, may be used aliphatic and aromatic aldehydes such as formalin, butyraldehyde, valeraldehyde and benzaldehyde, and the like. As examples of the amide compound, may be mentioned acetoamide, benzamide, methoxybenzamide, nitrobenzamide, N-methylbenzamide, butyramide, phthalamide, glutaric amide, etc. Copolymers comprising, as one component, an N-methylolacrylamide monomer may also be used as the N-hydroxymethylamide compound.

As the alkylating agent, may be used principally alkyl halides such as benzyl bromide, benzyl chloride, bromohexane, bromopropane and chloropentane, chloromethyl ether, dimethylsulfuric acid, methyl p-toluenesulfonate, and the like.

As the Friedel-Crafts catalyst, may be used any conventionally known catalysts, for example, halides of metals or metalloides, such as $BF_3$, $BF_3O(C_2H_5)_2$, $BCl_3$, $AlCl_3$, $TiCl_4$, $SnCl_4$, $FeCl_3$, $WCl_6$, POCl and $(C_2H_5)_2AlCl$.

(iii) There is a further process in which a nitrile oxide, nitrile imine or nitrile ylide is reacted with a polymer having at least one carbon-carbon unsaturated bond in its molecular chain to add it to the unsaturated bond, thereby conducting a reaction known as the 1,3-dipole addition reaction, and the reaction product is then reacted with an alkyl halide, dimethylsulfuric acid or the like, thereby achieving N-alkylation [Huisgen, Angew. Chem., 75, 604 (1963)].

The reaction introducing an isoxazoline ring with the nitrile oxide is disclosed in the literature by Tada, Numata, et al. [Journal of Japan Rubber Society, 43, 996 (1970) ].

(iv) There is a still further process in which a halohydroxyimino compound such as α-chlorohydroxyimino-propanal is reacted with a polymer having at least one carbon-carbon unsaturated bond in its molecular chain in the presence of a dehydrochlorinating agent such as an anhydrous sodium carbonate. The resultant product is reacted further with an alkyl halide, dimethylsulfuric acid or the like, thereby achieving N-alkylation.

(3) As a process for introducing $>C{=}N^+<$ bonds on at least one terminal of the molecular chain and in the molecular chain, may be mentioned the combination of the processes (1) and (2).

Long-chain Alkyl Phosphate

The long-chain alkyl phosphate represented by the general formula [I] is a phosphoric ester in which $R_1$ and $R_2$are individually a hydrocarbon radical having 8–30 carbon atoms. As examples thereof, may be mentioned octyl phosphate, dodecyl phosphate, stearyl phosphate, behenyl phosphate, dioctyl phosphate, didodecyl phosphate, distearyl phosphate, dibehenyl phosphate, salts thereof, and esters of an adduct of an alcohol or alkylphenol having 8–30 carbon atoms with an alkylene oxide and phosphoric acid.

Alkyl Sulfosuccinate or Salt Thereof

The alkyl sulfosuccinate or salt thereof represented by the general formula [II] is an alkyl sulfosuccinate or salt thereof in which $R_5$ and $R_6$ are individually a hydrogen atom or a hydrocarbon radical having 4–18 carbon atoms. As examples thereof, may be mentioned dibutyl sulfosuccinate, dioctyl sulfosuccinate, butyl octyl sulfosuccinate, dilauryl sulfosuccinate, distearyl sulfosuccinate, and sodium and potassium salts thereof.

The dispersing agent according to the present invention uses the polymer (1) in combination with the long-chain alkyl phosphate and/or the alkyl sulfosuccinate or salt thereof, and exhibits a synergistic effect which can not be achieved by their single use.

Although the proportion of the polymer (1) and the long-chain alkyl phosphate to be used varies the asphaltene content of a fuel oil to which the dispersing agent is to be added, it is generally 20:80 to 95:5 by weight. The proportion of the polymer (1) and the alkyl sulfosuccinate or salt thereof to be used is generally 5:95 to 95:5 by weight.

When the dispersing agent according to the present invention is added to a fuel oil, a stable fuel oil composition excellent in dispersion stability of asphaltene and suppressed in formation of sludge can be obtained even if the fuel oil is an unstable fuel oil containing asphaltene in a high proportion.

The amount of the dispersing agent of the present invention to be added is generally at least 100 ppm, preferably 100 ppm–5.0 wt. %, more preferably 300 ppm–2.0 wt. % based on the fuel oil.

The dispersing agent according to the present invention can be used in combination with an antioxidant such as a hindered phenol such as 2,6-di-tert-butyl-p-cresol or 2,6-di-tert-butylphenol, or an amine such as N,N'-diisopropyl-p-phenylenediamine or N,N'-dibutyl-p-phenylene-diamine; a combustion improver such as the sulfonate, naphthenate or phenol salt of a metal such as calcium, magnesium, barium, chromium, cobalt, manganese or iron; an anticlouding agent; an anti-knock agent; an ash improver such as calcium oxide, magnesium oxide, calcium carbonate, magnesium carbonate or alumina; a colorant such as an azo dye; a pour point depressant (flow improver) such as polybutene, polymethacrylate, polystyrene, polyvinyl acetate or an ethylene-vinyl acetate copolymer; a surfactant-type additive such as polyoxyalkylene amine or polyoxyalkylene sorbitan; and/or the like.

The dispersing agent according to the present invention may be added to a fuel oil after dissolving it in advance in a diluent solvent, for example, xylene, kerosene, light lubricant base, heavy aromatic naphtha or the like. Besides, the reaction mixture upon the production of the polymer may be concentrated or diluted and then added to the fuel oil.

ADVANTAGES OF THE INVENTION

The dispersing agent according to the present invention can favorably disperse components contained in a straight or cracked base, such as asphaltene and sludge. As a result, the use of a fuel oil making use of the dispersing agent according to the present invention permits the avoidance of various troubles due to the occurrence of sludge.

EMBODIMENTS OF THE INVENTION

The present invention will hereinafter be described more specifically by the following examples and comparative examples. However, it should be borne in mind that this invention is not limited by and to these examples only. Incidentally, all the designations of "part" or "parts" and "%" which will appear in the following examples mean part or parts by weight and wt. % unless specially noted.

The following methods were followed for the measurement of the physical properties in the following examples.

<Spot test>

The stability of each fuel oil was evaluated by means of an "FS-TESTER" (manufactured by Nippon Oil Co., Ltd.) based on ASTM Spot Test (D-2781).

More specifically, after a sample fuel oil is heated to 80° C., a part of the sample oil is dipped up with a glass rod, one drop of which is caused to fall on filter paper heated to 80° C. After leaving to stand for 30 minutes, a spot on the test filter paper is compared with standard spots to evaluate the initial stability of the fuel oil. The sample spot spread on the filter paper is compared with the standard spots to select a standard spot corresponding to the sample spot and then record its spot number (see Table 1). The lower the spot number, the better the initial stability.

TABLE 1

| Spot No. | Criterion |
|---|---|
| 1 | No inner ring developed, and a spot was even. |
| 2 | A faint or slight inner ring developed. |
| 3 | A faint but clearer inner ring developed, but it was only slightly darker than a background. |
| 4 | A still clearer inner ring developed, which was thicker than the thickness of the ring in No. 3 and somewhat darker than a background. |
| 5 | There were particles or particulate matter in the center of an inner ring which was much darker than a background. |

<Filtration test>

A filtration test was conducted in accordance with the Shell Hot Filtration Test, SMS 2696 method.

More specifically, 100 ml of a sample fuel oil heated to 70° C. is filtered under reduced pressure at 70° C. by means of a glass fiber filter (Whatman, GF/A, diameter: 47 mm). Sludge captured on the filter is determined to express its dry weight in terms of the weight (mg) per 100 ml of the sample fuel oil.

By the way, this testing method is a partly revised version of the testing method described in the April 8, 1985, issue of "Oil-Gas Journal".

[Synthesis Experiment 1]

After a stainless steel polymerization reactor having an internal volume of 2 liters was washed, dried and purged with dry nitrogen gas, it was charged with 98.4 g of 1,3-butadiene, 820 g of benzene and 14.04 mM of n-butyl lithium (a solution in n-hexane). The contents were subjected to a polymerization reaction at 40° C. for 1 hour while stirring them. After confirmed that the polymerization of butadiene was substantially completed, 21.4 g of styrene was added to the reaction system. After the polymerization of styrene was completed, 14.04 mM of N-methyl-2-pyrrolidone was added to the reaction mixture to react them for 10 minutes. The contents in the reactor were then poured into a methanol solution containing 2% of 2,6-di-tert-butyl-p-cresol to solidify a polymer formed. The polymer was dried in a vacuum drier for 24 hours to obtain Polymer (A). Polymer (A) (having $>C{=}N^{+}<$ bonds on the terminals of the polymer chain) contained 18% of bound styrene and had a number average molecular weight of 14,000 as determined by GPC in terms of standard polystyrene.

[Synthesis Experiment 2]

Polymerization was conducted in the same conditions as in Synthesis Experiment 1 except that N-methyl-2-pyrrolidone was not reacted, thereby obtaining Polymer (a). Using Polymer (a) thus obtained, $>C{=}N^{+}<$ bonds were introduced in its molecular chain in accordance with the following reaction.

One hundred grams of Polymer (a) were dissolved in 500 ml of toluene, and the resulting solution was placed in a glass reactor equipped with a stirrer, interior heater, steam condenser and liquid-solid inlets. The contents were heated to 50° C. with stirring.

Each 0.1 mole of their corresponding modifiers 1 and 2 shown in Table 2 were then added to portions of the reaction mixture to react them for about 2 hours. After small amounts of methanol were added to the respective reaction mixtures to stop the respective reactions, the reaction mixtures were separately poured into 3 liters of methanol to solidify reaction products. The resulting products were dried in a vacuum dryer to obtain modified Polymers B and C.

TABLE 2

| | Polymer B | Polymer C |
|---|---|---|
| Polymer having unsaturated bond | Polymer (a) | Polymer (a) |
| Modifier 1 | Benzylidene-octylamine | |
| | Acetyl chloride | |
| Modifier 2 | Titanium tetrachloride | Tin tetrachloride |
| Functional group introduced | Oxazinium ion | Oxazinium ion |

[Preparation of Dispersing Agent]

Dispersing agents (Additives 1 through 6) having their corresponding compositions shown in Table 3 were prepared from the modified polymers obtained in the above-described synthesis experiments and long-chain alkyl phosphates shown in Table 3. Incidentally, these additives were dissolved in Mideast crude gas oil to give a solid concentration of 60% before their use.

Further, dispersing agents (Additives 7 through 12) having their corresponding compositions shown in Table 4 were prepared from the modified polymers obtained in the above-described synthesis experiments and alkyl sulfo-succinates or salts thereof shown in Table 4. Incidentally, these additives were dissolved in Mideast crude gas oil to give a solid concentration of 50% before their use.

TABLE 3

| Additive | Composition [compositional ratio] |
|---|---|
| Additive 1 | Polymer A [30]/PRISURF A 212E (*1) [70] |
| Additive 2 | Polymer A [50]/PRISURF A 212E (*1) [70] |
| Additive 3 | Polymer A [70]/PRISURF M 208B (*2) [70] |
| Additive 4 | Polymer A [50]/PRISURF A 215C (*3) [70] |
| Additive 5 | Polymer B [50]/PRISURF A 212E (*1) [50] |
| Additive 6 | Polymer C [50]/PRISURF M 208B (*2) [50] |

(*1) PRISURF A 212E (product of Dai-ich Kogyo Seiyaku Co., Ltd.); acid value: 80–95, melting point: 10° C. or lower, HLB: 10.3.
(*2) PRISURF M 208B (product of Dai-ich Kogyo Seiyaku Co., Ltd.); acid value: 98.5 or higher.
(*3) PRISURF A 215C (product of Dai-ich Kogyo Seiyaku Co., Ltd.); acid value: 80–95, melting point: 20° C. or lower, HLB: 11.5.

TABLE 4

| Additive | Composition [compositional ratio] |
|---|---|
| Additive 7 | Polymer A [70]/LIPAL 860K (*4) [30] |
| Additive 8 | Polymer A [90]/LIPAL 860K (*4) [10] |
| Additive 9 | Polymer A [70]/LIPAL NSC (*5) [30] |
| Additive 10 | Polymer A [50]/PELEX OT-P (*6) [50] |
| Additive 11 | Polymer B [70]/LIPAL 860K (*4) [30] |
| Additive 12 | Polymer C [70]/PELEX OT-P (*6) [30] |

(*4) LIPAL 860K (product of Lion Corporation).
(*5) LIPAL NSC (product of Lion Corporation).
(*6) PELEX OT-P (product of Kao Corporation).

[Examples 1–16 and Comparative Examples 1–12]

After the additives shown in Table 3 were separately added in predetermined amounts to C-type fuel oils having properties shown in Table 5, and the resulting mixtures were thoroughly stirred, A-type fuel oil was added to the mixtures in a manner shown in Table 6, thereby preparing A/C blended fuel oils a through g. Sludge conditions of these fuel oil samples were determined by the spot test and filtration test described above. The results are shown in Table 7.

TABLE 5

| | A-type fuel oil (Mideast crude gas oil) | C-Type fuel oil | |
|---|---|---|---|
| | | C30LP-R (MT) | IBF-180 |
| Density (150° C.) (g/cm$^3$) | 0.864 | 0.958 | 0.958 |
| Pour point (°C.) | −15 | 5 | 5 |
| Sulfur content (wt. %) | 0.94 | 2.54 | 2.54 |
| Kinematic viscosity (50° C.) (cst) | 2.70 | 162 | 162 |
| Carbon residue (wt. %) | — | 9.0 | 12.0 |

TABLE 6

| Sample fuel oil | A-type fuel oil | C-Type fuel oil | |
|---|---|---|---|
| | | C30LP-R | IBF-180 |
| Fuel oil a | 70 | 30 | — |
| Fuel oil b | 50 | 50 | — |
| Fuel oil c | 30 | 70 | — |
| Fuel oil d | 70 | — | 30 |
| Fuel oil e | 50 | — | 50 |

TABLE 6-continued

| Sample fuel oil | A-type fuel oil | C-Type fuel oil | |
|---|---|---|---|
| | | C30LP-R | IBF-180 |
| Fuel oil f | 30 | — | 70 |
| Fuel oil g | — | 100 | — |

TABLE 7

| | Sample oil | Additive | Amount added (ppm) (*7) | Spot test No. | Filtration test, amount of dry sludge (mg/100 ml) |
|---|---|---|---|---|---|
| Ex. 1 | a | 1 | 500 | 2 | 19 |
| Ex. 2 | b | 1 | 1000 | 2 | 15 |
| Ex. 3 | c | 1 | 500 | 3 | 28 |
| Ex. 4 | c | 1 | 1000 | 2 | 19 |
| Ex. 5 | c | 2 | 1000 | 2 | 23 |
| Ex. 6 | c | 3 | 1000 | 3 | 26 |
| Ex. 7 | c | 4 | 1000 | 2 | 25 |
| Ex. 8 | c | 5 | 1000 | 2 | 22 |
| Ex. 9 | c | 6 | 1000 | 3 | 26 |
| Ex. 10 | d | 2 | 1000 | 3 | 59 |
| Ex. 11 | d | 5 | 1000 | 3 | 63 |
| Ex. 12 | e | 1 | 1000 | 2 | 26 |
| Ex. 13 | e | 3 | 1000 | 3 | 29 |
| Ex. 14 | e | 6 | 1000 | 2 | 20 |
| Ex. 15 | f | 2 | 1000 | 3 | 48 |
| Ex. 16 | g | 2 | 1000 | 2 | 19 |
| Comp. Ex. 1 | a | Not added | | 4 | 32 |
| Comp. Ex. 2 | b | Not added | | 3 | 28 |
| Comp. Ex. 3 | b | Polymer A | 1000 | 3 | 25 |
| Comp. Ex. 4 | c | Not added | | 5 | 58 |
| Comp. Ex. 5 | c | Polymer A | 1000 | 5 | 59 |
| Comp. Ex. 6 | c | Phosphoric acid (*8) compound | 1000 | 4 | 43 |
| Comp. Ex. 7 | d | Not added | | 6 | 125 |
| Comp. Ex. 8 | d | Polymer B | 1000 | 5 | 110 |
| Comp. Ex. 9 | e | Not added | | 5 | 74 |
| Comp. Ex. 10 | e | Polymer C | 1000 | 4 | 70 |
| Comp. Ex. 11 | f | Not added | | 6 | 118 |
| Comp. Ex. 12 | g | Not added | | 3 | 32 |

(*7) Added as a 60% solution in gas oil.
(*8) PRISURF A 212E.

[Examples 17–28 and Comparative Examples 13–21]

After the additives shown in Table 4 were separately added in predetermined amounts to C-type fuel oils having properties shown in Table 5, and the resulting mixtures were thoroughly stirred, A-type fuel oil was added to the mixtures in a manner shown in Table 8, thereby preparing A/C blended fuel oils h through l. Sludge conditions of these fuel oil samples were determined by the spot test and filtration test described above. The results are shown in Table 9.

TABLE 8

| Sample fuel oil | A-type fuel oil | C-Type fuel oil | |
|---|---|---|---|
| | | C30LP-R | IBF-180 |
| Fuel oil h | 70 | 30 | — |
| Fuel oil i | 50 | 50 | — |
| Fuel oil j | 30 | 70 | — |
| Fuel oil k | 70 | — | 30 |

TABLE 8-continued

| Sample fuel oil | A-type fuel oil | C-Type fuel oil C30LP-R | C-Type fuel oil IBF-180 |
|---|---|---|---|
| Fuel oil 1 | — | 100 | — |

TABLE 9

| | Sample oil | Additive | Amount added (ppm) (*9) | Spot test No. | Filtration test, amount of dry sludge (mg/100 ml) |
|---|---|---|---|---|---|
| Ex. 17 | h | 7 | 500 | 2 | 31 |
| Ex. 18 | i | 7 | 1000 | 2 | 23 |
| Ex. 19 | j | 7 | 500 | 2 | 28 |
| Ex. 20 | j | 7 | 1000 | 2 | 19 |
| Ex. 21 | j | 8 | 1000 | 2 | 26 |
| Ex. 22 | j | 9 | 1000 | 2 | 29 |
| Ex. 23 | j | 10 | 1000 | 2 | 27 |
| Ex. 24 | j | 11 | 1000 | 2 | 25 |
| Ex. 25 | j | 12 | 1000 | 2 | 24 |
| Ex. 26 | k | 8 | 1000 | 3 | 235 |
| Ex. 27 | k | 11 | 1000 | 3 | 274 |
| Ex. 28 | l | 8 | 1000 | 2 | 30 |
| Comp. Ex. 13 | h | Not added | | 4 | 32 |
| Comp. Ex. 14 | i | Not added | | 3 | — |
| Comp. Ex. 15 | i | Polymer A | 1000 | 3 | 48 |
| Comp. Ex. 16 | j | Not added | | 5 | 71 |
| Comp. Ex. 17 | j | Polymer A | 1000 | 5 | 59 |
| Comp. Ex. 18 | j | Alkyl (*10) sulfo-succinate | 1000 | 4 | 48 |
| Comp. Ex. 19 | k | Not added | | 6 | 603 |
| Comp. Ex. 20 | k | Polymer B | 1000 | 5 | 541 |
| Comp. Ex. 21 | l | Not added | | 4 | 74 |

(*9) Added as a 60% solution in gas oil.
(*10) LIPAL 860K (product of Lion Corporation).

What is claimed is:

1. A sludge dispersing agent for fuel oils, comprising (1) a polymer having at least one $>C{=}N^{+}<$ bond in its molecule and (2) an alkyl sulfosuccinate or salt thereof represented by the following general formula [II]:

$$\begin{array}{l} R_5OCOCH_2 \\ \quad\quad | \\ R_6OCOCHSO_3M \end{array} \qquad [II]$$

wherein $R_5$ and $R_6$ are individually a hydrogen atom or a hydrocarbon radical having 4–18 carbon atoms, and M denotes a hydrogen or alkali metal atom, and further wherein the polymer (1) and compound (2) are used in a proportion of 5:95 to 95:5 by weight.

2. The sludge dispersing agent as claimed in claim 1, wherein the polymer (1) is soluble in a distillate oil in a temperature range of from −30° C. to 160° C.

3. The sludge dispersing agent as claimed in claim 1, wherein the polymer (1) has the $>C{=}N^{+}<$ bond or bonds on at least one terminal of its molecular chain, in the molecular chain, or both on at least one terminal of the molecular chain and in the molecular chain, said bond or bonds having been introduced by a modification reaction.

4. The sludge dispersing agent as claimed in claim 3, wherein the polymer (1) having the $>C{=}N^{+}<$ bond on at least one terminal of its molecular chain has been obtained by reacting a polymer having an active terminal with an alkali metal or alkaline earth metal bonded to its terminal with an N-substituted lactam, N-substituted thiolactam, N-substituted cyclic urea, N-substituted cyclic thiourea, N-substituted aminoaldehyde, N-substituted aminothioaldehyde, N-substituted aminoketone or N-substituted aminothioketone, and then hydrolyzing the resulting reaction product.

5. The sludge dispersing agent as claimed in claim 3, wherein the polymer (1) having the $>C{=}N^{+}<$ bond in its molecular chain has been obtained by reacting a polymer having at least one carbon-carbon unsaturated bond in its molecular chain with (i) an organic compound represented by the general formula, $R_1{-}CH{=}N{-}R_2$ wherein $R_1$ and $R_2$ mean individually an organic atomic group, and an organic acid halide in the presence of a Lewis acid, (ii) with an N-hydroxymethylamide compound in the presence of a Friedel-Crafts catalyst so as to achieve N-alkylation, (iii) with a nitrile oxide, nitrile imine or nitrile ylide and then an alkyl halide or dimethylsulfuric acid so as to achieve N-alkylation, or (iv) with a halohydroxyimino compound in the presence of a dehydrochlorinating agent and then an alkyl halide or dimethylsulfuric acid so as to achieve N-alkylation.

6. The sludge dispersing agent as claimed in claim 3, wherein a starting polymer is a diene polymer, olefin polymer, aromatic vinyl compound-conjugated diene copolymer or aromatic vinyl compound-olefin copolymer.

7. A fuel oil composition obtained by adding the sludge dispersing agent as claimed in claim 1 to a fuel oil.

8. The fuel oil composition as claimed in claim 7, wherein the amount of the sludge dispersing agent added falls within a range of from 100 ppm to 5.0 wt. % based on the fuel oil.

* * * * *